US006192604B1

(12) United States Patent
Morrison

(10) Patent No.: US 6,192,604 B1
(45) Date of Patent: Feb. 27, 2001

(54) DRYING SYSTEM IN A SPRAYBOOTH

(75) Inventor: Neil Morrison, Rochdale (GB)

(73) Assignee: Junair Spraybooths Limited, Manchester (GB)

( * ) Notice: Subject to any disclaimer, the term of this patent is extended or adjusted under 35 U.S.C. 154(b) by 0 days.

(21) Appl. No.: 09/370,747

(22) Filed: Aug. 9, 1999

Related U.S. Application Data

(63) Continuation of application No. PCT/GB98/00249, filed on Feb. 9, 1998.

(30) Foreign Application Priority Data

Feb. 7, 1997 (GB) ..... 9702473

(51) Int. Cl.[7] ..... F26B 19/00

(52) U.S. Cl. ..... 34/666; 34/202; 34/210; 34/218

(58) Field of Search ..... 34/272, 443, 487, 34/666, 202, 210, 218; 134/57 R, 107, 109; 454/51, 52, 54; 118/309, 326, 665; 15/312.1, 312.2, 316.1

(56) References Cited

U.S. PATENT DOCUMENTS

| | | | | |
|---|---|---|---|---|
| 2,663,951 | * | 12/1953 | Kennison | 34/666 |
| 3,375,592 | * | 4/1968 | Heinicke et al. | 34/666 |
| 3,909,953 | * | 10/1975 | Hemsath et al. | 34/450 |
| 4,771,552 | | 9/1988 | Morioka . | |
| 4,785,552 | * | 11/1988 | Best | 34/68 X |
| 5,005,272 | | 4/1991 | Severinsen . | |
| 5,033,489 | * | 7/1991 | Ferre et al. | 134/57 R |
| 5,555,649 | | 9/1996 | Phillipson . | |
| 5,568,692 | * | 10/1996 | Crompton et al. | 34/666 |
| 5,743,958 | * | 4/1998 | Shuti | 118/308 |
| 5,853,215 | * | 12/1998 | Lowery | 296/24.1 |
| 5,875,565 | * | 3/1999 | Bowman | 34/666 |
| 5,930,911 | * | 8/1999 | Alward | 34/666 |

FOREIGN PATENT DOCUMENTS

| | | |
|---|---|---|
| 0 268 691 A1 | 11/1986 | (EP) . |
| 0 568 179 A1 | 11/1993 | (EP) . |
| 0 678 719 A2 | 4/1995 | (EP) . |
| 0 690 279 A1 | 1/1996 | (EP) . |

* cited by examiner

*Primary Examiner*—Stephen Gravini
(74) *Attorney, Agent, or Firm*—Akin, Gump, Strauss, Hauer & Feld, L.L.P.

(57) ABSTRACT

A paint drying system for drying painted motor cars, particularly those cars painted with water-born paints. The system includes a spray booth (2) which is supplied with heated air which flows in a downdraft from an upper inlet (32) to a lower outlet (44) and also from wall-mounted air jets. The air from the air jets disrupts the downdraft causing air turbulence within the spraybooth (2) which accelerates drying of the painted cars. In a preferred embodiment, the spraybooth has corner mounted air jets.

51 Claims, 4 Drawing Sheets

DRYING SYSTEM IN A SPRAYBOOTH

CROSS-REFERENCE TO RELATED APPLICATION

This application is a continuation of International Application PCT/GB98/00249, filed Feb. 9, 1998, the disclosure of which is incorporated herein by reference.

BACKGROUND OF THE INVENTION

The invention relates to a paint drying system for painted bodies, especially automobiles and particularly, but not exclusively, a system for drying painted motor cars.

Conventional automobile spraybooths dry solvent-borne paints which have been applied onto the surfaces of an automobile by passing heated air over the painted surface. Typically, heated air is blown down through inlets in a ceiling of the booth and is evacuated through floor outlets. This process involves the release of polluting solvents into the atmosphere after the paint has dried. In an effort to conform with new legislation which regulates the use of solvent-borne paints, paint manufacturers have developed new paints, such as water-borne paints which are less damaging to the environment.

However, the conventional paint drying spraybooth has proved unsuitable for the drying of water-borne paints. This is because it relies on the volatility of the paint solvent to dry the paint quickly. As water is not volatile it takes substantially longer to evaporate under normal ambient conditions. The water in water-borne paints is thereby released more slowly, resulting in extended drying times when using conventional drying systems. The drying of water-borne paints is further hindered when ambient humidity levels rise. Experiments involving dehumidification techniques have proved impractical and expensive.

It is also known, as described in EP 0 690 279, to dry water-borne paints with directional air jets using re-circulated air from within the spraybooth. As described in this specification, the jets are directly optically aligned with individual painted surfaces to be dried. The specification states that the directional air jets, when used with heat lamps, reduce the drying times for one vehicle from 60 minutes to 8–14 minutes. This is still significantly longer than is required for the drying of solvent-borne paints. Furthermore, since the air jets are individually aimed directly at painted surfaces, water may be entrained in the paint resulting in subsequent blistering of the paint surface.

SUMMARY OF THE INVENTION

An object of the present invention is to overcome or ameliorate the problems in drying water-borne paints by providing a paint drying system which can dry water-borne paint treated automobiles particularly, but not exclusively, motor cars efficiently, cost effectively and on a time scale comparable to the drying time of solvent-paints.

According to one aspect of the invention therefore there is provided a paint drying system for drying a painted body, the system comprising a spraybooth having a enclosure, an air inlet, an air outlet, pump means and a heater to supply air from the atmosphere externally of the booth to the air inlet to flow through the enclosure from the air inlet to the air outlet, characterised by the provision of at least one further air inlet which receives air from the atmosphere externally of the booth and directs this air into the enclosure transversely to said air flow, heating means being provided to heat such air.

Advantageously, the paint drying system may be used for drying a body painted with a water-borne paint. Preferably the body is an automobile, and particularly a motor car.

Many paints, including water borne paints, are usually applied as a series of layers or coats and the paint may require drying after each coat is applied. Accordingly, the system of the present invention may be used to dry water borne paint during what is known as the "flash-off period" or "flash-off cycle". During this period the water or solvent in the paint is driven off, either after each individual coat is applied or after a number of coats have been applied. Where the paint must be dried in between coats of paint, the paint drying system of the present invention ensures thorough drying between coats so that water is not trapped within the paint film.

Certain paints are cured in a baking operation following flash-off cycle. During a baking operation, hot air (normally at a temperature of 80° C.) is re-circulated in the enclosure.

In accordance with convention, therefore, the enclosure may also be used for paint spraying, and baking operations.

With the system of the invention, a body painted with a water-borne paint can be efficiently dried in a period of time comparable with the time taken to dry solvent-borne paints using conventional drying systems and without surface film problems.

Air introduced via the further air inlets disrupts such air flow to cause turbulent air flow within the enclosure and this high air movement accelerates the drying of the painted body. The pump and\or the heater may be located in any suitable position, and may for instance be located on, adjacent or within the air inlet system.

It is preferable to avoid the flow of air directly onto, i.e. perpendicular to a painted surface (of the motor car). This may lead to the unwanted entrainment of water in the paint which can cause blistering thereof.

Accordingly, it is preferable that the further air inlet is operable to direct air obliquely at a painted surface (of the automobile).

This encourages high air movement in the form of vortices adjacent the painted surface which accelerates the drying thereof, but without the undesirable entrainment water in the paint.

The air inlet may be in the form of an air inlet system which includes an air inlet duct or ducting in which said heater may be located.

Preferably air entering the air inlet system is heated to a temperature of 35° C. by said heater, however it may be lower if required, for example, when the body is painted in the enclosure.

The air inlet system may include a plenum chamber located in between the air inlet duct/ducting and the enclosure, the plenum chamber having an inlet and an outlet so as to allow air to flow from the inlet duct/ducting to the enclosure.

Preferably the plenum chamber is above to withstand high air pressures.

The plenum chamber may be any suitable shape such as a box construction.

The plenum chamber may house said pump means which is operable to draw air from the inlet duct through the plenum chamber and into the enclosure.

Preferably air enters the enclosure via the plenum chamber filters at a speed of 0.2–1 $ms^{-1}$, and preferably at 0.5 $ms^{-1}$.

Preferably, the air is filtered prior to entering the enclosure, and this may be effected by any suitable means, such as synthetic filter.

Preferably the filter is operative to remove particles exceeding 10 microns in diameter.

The filtering of the inlet air reduces contamination of the painted surfaces over which the air flows, which would otherwise lead to particles of dust, etc. being entrained in the painted surface which can cause spoiling of the surface, an effect known as peppering.

The further air inlet may receive air via air supply means which may include a duct or ducting and may include one or more fans operable to draw air through the further air inlet and into the enclosure.

The further air inlet may receive said air from the air inlet system and accordingly the air inlet system may be connected to the further air inlet by means of a duct or ducting.

Preferably said means for heating the air which is directed into the enclosure by the further air inlet is said heater. Alternatively or additionally said means may comprise one or more further heaters which may be located on, adjacent or within the further air inlet.

The further air inlet may incorporate one or more further pumps or fans.

Preferably the further air inlet is operable to direct air into the enclosure at 2–40 $ms^{-1}$ and particularly preferably at 25 $ms^{-1}$.

Preferably, the further air inlet includes one or more air jets to affect direction of the air into the enclosure. The or each air jet may simply comprise an opening through which air may flow or alternatively the or each air jet may be a nozzle/spray jet structure of any suitable form.

The air jets may comprise any suitable material but preferably the material has anti-static properties. One preferred material is aluminium.

The use of anti-static material may prevent paint particles adhering to the nozzles, reducing the possibility of contamination of the spraybooth air by such particles.

The or each air jet may be in or adjacent one or more walls or corners of the enclosure.

Alternatively the or each air jet may be mounted on a support member which may be located within the enclosure interior.

The or each support member may be mounted on a wall of the enclosure so that the or each support member and wall together define an enclosure or passageway receives the air.

Alternatively, the or each support member may be in the form of a prefabricated enclosure which is arranged in the enclosure so as to receive the air.

Preferably, the or each support member is in the form of a corner unit, which is shaped so as to fit in a corners of the enclosure.

This arrangement conveniently positions the or each air jet so as to be operable to direct air obliquely at surfaces of the automobile.

Preferably, the passageway is connected, e.g. via ducting to the air inlet system so as to receive air therefrom.

There may be a plurality of air jets arranged in one or more columns along the support member.

Preferably there are four elongate corner units within the enclosure, each corner unit having a plurality of air jets along its length, each air jet operable to introduce gas into the enclosure at a speed in the range of 2 $ms^{-1}$–40 $ms^{-1}$ and particularly preferably at 25 $ms^{-1}$. The air jets may comprise a partially spherical member having an aperture therethrough which allows the gas to pass from the passageway into the enclosure. The air jets may also comprise any other suitably shaped member such as a cylinder, rectangle.

There may be two sets of four air jets on each corner unit. The air jets may be housed so that each set of four air jets may be generally vertically aligned upon the corner unit. Preferably the first may be positioned 300 mm from the base of the enclosure with the other three air jets being consecutively positioned 300 mm apart.

Each air jet may be adjustably mounted relative to the corner unit to allow adjustment of the direction of the air flow therefrom. Adjustment may be effected manually, electrically or by any other suitable means and allows even thorough drying even with off car panels.

Where the air jet is manually adjustable, adjustment may be more easily and accurately effected by means of a directing member. The air jet may include a housing into which the directing member may be inserted, thereby enabling the air jet to be adjusted by movement of the member. The directing member may comprise an elongate arm and may take any suitable shape Preferably the air received by the further air inlet is filtered prior to direction into the enclosure. This may be achieved by any suitable filter, for instance a synthetic filter incorporated in the further air inlet.

Where the further air inlet incorporates one or more support members defining an enclosure or passageway, the filter may comprise a synthetic filter bag fitted into the enclosure or passage.

Preferably the filter is operative to remove particles greater than 10 microns in size from entering the enclosure.

The air outlet system may comprise an outlet duct which incorporates one or more pumps or fans to extract the air from the enclosure into the atmosphere external of the spraybooth.

Preferably, the enclosure is negatively (or at least neutrally) pressurised. This may be achieved by control of the air flow in relative to the air flow out of the enclosure, i.e. by extracting the air from the enclosure at a greater rate than (or at least the same rate as) it is introduced into the enclosure.

The enclosure may include one or more internal doors and the or each door may be arranged on or adjacent to the further air inlet and operable to effect open and closure thereof.

Where the air inlet includes a number of air jets, a door may be mounted adjacent the or each air jet so that the air jets may be closed individually.

Alternatively, where the enclosure includes a number of support members on which there are mounted one or more air jets, a door may be mounted adjacent each support member so the one door may close off all air jets on the support member.

The enclosure may also have one or more external doors thereby allowing an operator/motor car entry into and exit from the enclosure.

The paint drying system may be fully or partially automated by means of a control system which may enable precise control of system parameters and remote operation of the drying system.

The control system may be operative to control the temperature of the air flowing through the enclosure from the air inlet and the further air inlet via a thermostat or other temperature controller which may be linked to the or each heater.

The control system may incorporate a timer so that, for example, the temperature may be linked to a timer so that the desired air temperature The control system may also be operative to control open and closure of said internal doors remotely of said internal doors.

This means that the drying system may be operated without any handling of the internal doors. The enclosure can therefore be maintained free from contaminants which could otherwise be transferred from a painter's overalls into the enclosure air by the high velocity air flow from the further air inlet in the enclosure. Contaminants in the enclosure air could lead to paint defects.

The control system may include a user interface unit. Operation of the control system may be via the interface unit for input of desired system parameters and the control system may further include a microprocessor-based control unit so that input parameters may be processed as required by said microprocessor-based control unit. The control system may further incorporate a data storage (memory) unit operable to store system parameters, pre-programmed drying cycles, etc.

One or more push buttons located on said control device may activate either a part of a drying cycle, e.g. door closure, pump(s) or the whole cycle.

The control system may incorporate an audible/visual alarm activated after a predetermined period of time e.g. when a drying cycle is complete.

In accordance with conventional practice the spraybooth enclosure may be used for both painting and drying of an automobile (or a part thereof). Thus, the control system may be used to control the flow rate and temperature of air entering the booth for ideal paint spraying conditions, i.e. a temperature of approximately 21° C. with internal doors shut (to protect the air jets from paint) open. Following the spraying operation, the internal doors open and the temperature increased to 35° C. for a predetermined length of time in order to dry the paint.

The air from the air jets disrupts the laminar flow in the enclosure giving a controlled high air movement over panels of the motor car. The optimum temperature of 35° C. is achieved and this, together with disruptive airflow accelerates water loss from the water borne paint which speeds up the drying thereof.

Using the paint drying system the time taken to dry a water-borne paint may be approximately 2–5 minutes.

This therefore allows a large number of vehicles to be dried over a period of time increasing throughput.

Advantageously, the paint drying system may be retrofitted to a conventional spraybooth.

Accordingly in a second aspect of the invention, there is provided an auxiliary air inlet for a paint drying system for drying a painted body which air inlet is suitable for use with a spraybooth, the spraybooth comprising a enclosure, an air inlet, an air outlet, a pump and a heater to supply air from the atmosphere externally of the spraybooth to the air inlet to flow through the enclosure from the air inlet to the air outlet; the auxiliary inlet comprising one or more air jets which receive air from the atmosphere externally of the spraybooth, the or each air jet being adjustably mounted in one or more pods, the or each pod adapted to be mounted in the enclosure so that the or each air jet directs air obliquely at surfaces of the painted body.

Preferably, the pod is mounted in or adjacent a corner of the enclosure.

Preferably the or each pod is a triangular shaped body and thereby easily located in the corner of the enclosure.

Advantageously, the auxiliary air inlet includes a control system operable to interface with and control the heater of the spraybooth. In the case where the spraybooth incorporates a temperature control means to control temperature of said air flow, preferably, the control system is operable to interface and override said temperature control means.

The control system may be operable to control other devices of the spraybooth for example, said pump.

In a third aspect there is provided a paint drying system for drying a painted body, the system comprising a spraybooth having a enclosure, an air inlet, an air outlet and a pump to supply air from the atmosphere externally of the booth to the air inlet to flow through the enclosure from the air inlet to the air outlet, characterised in the provision of at least one further air inlet which receives air from the atmosphere externally of the booth and directs this obliquely at surfaces of the painted body.

BRIEF DESCRIPTION OF THE SEVERAL VIEWS OF THE DRAWINGS

The invention will now be described further, by way of example only, and with reference to the accompanying drawings in which.

DETAILED DESCRIPTION OF THE INVENTION

Figure 1:
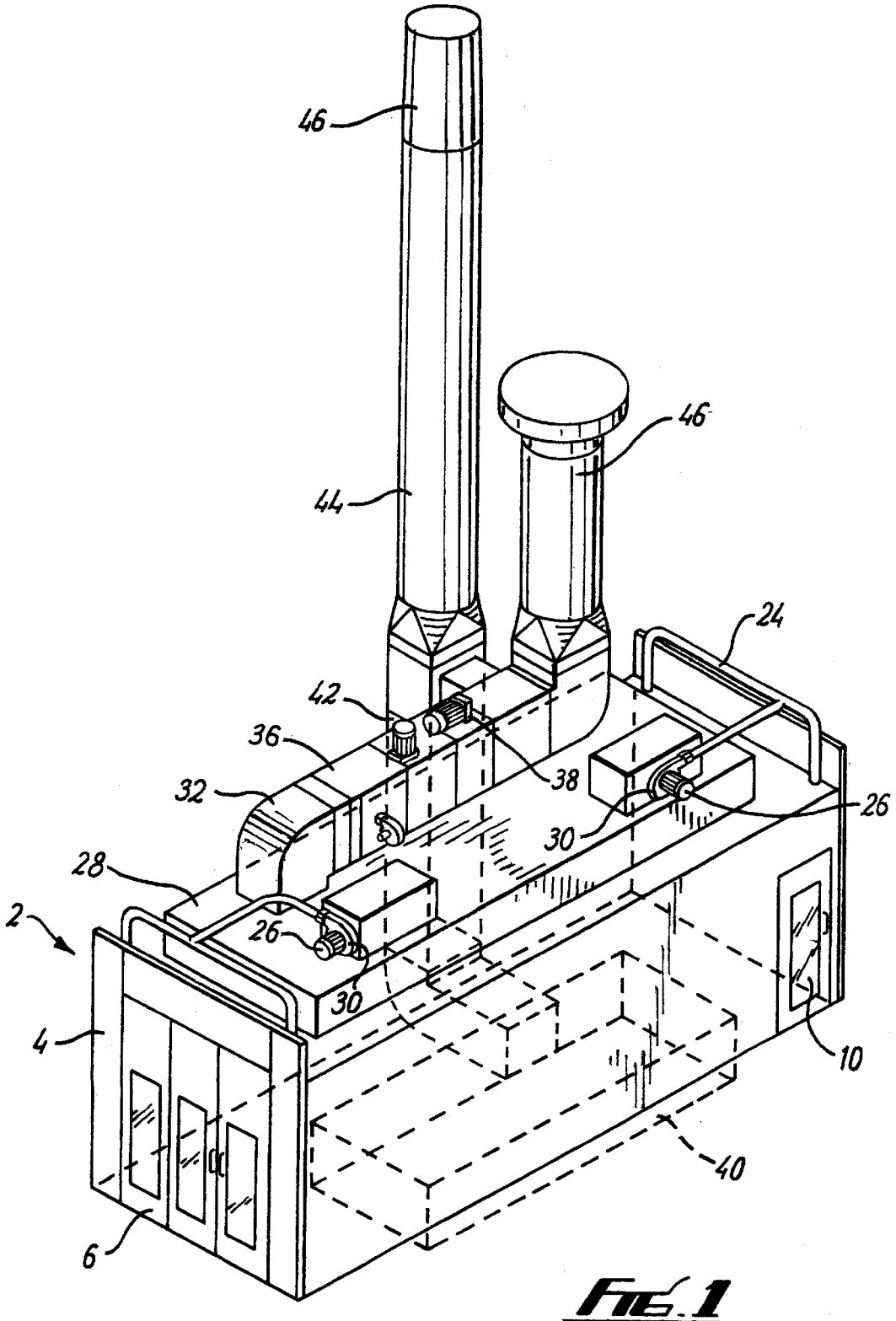
FIG. 1 is a perspective view of spraybooth of the paint drying system according to a first aspect of the invention.
Figure 2:
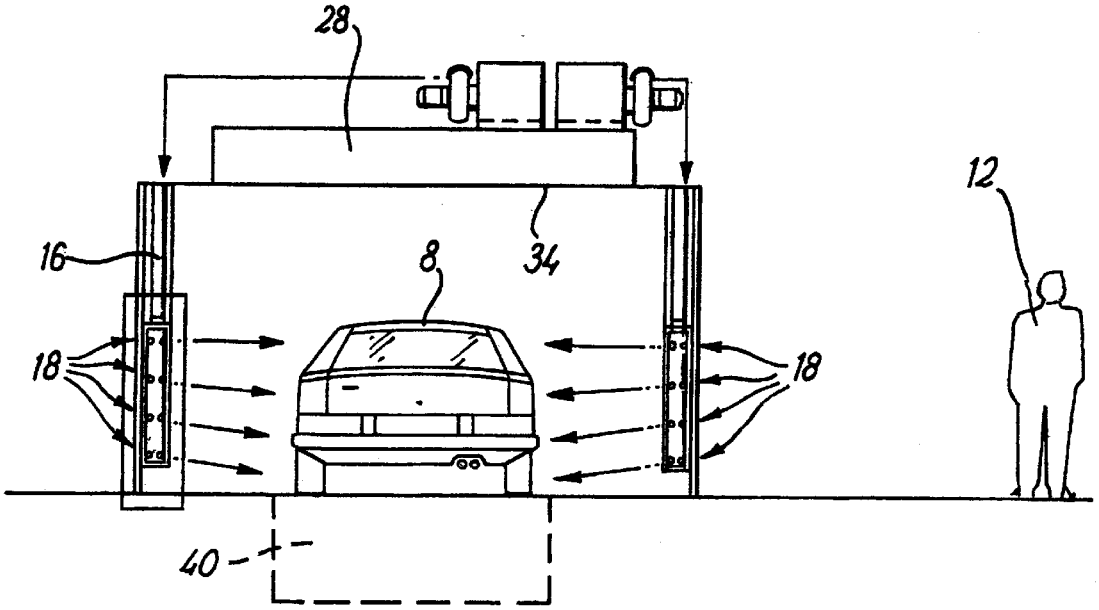
FIG. 2 is a rear view of the spraybooth of FIG. 1.
Figure 3:
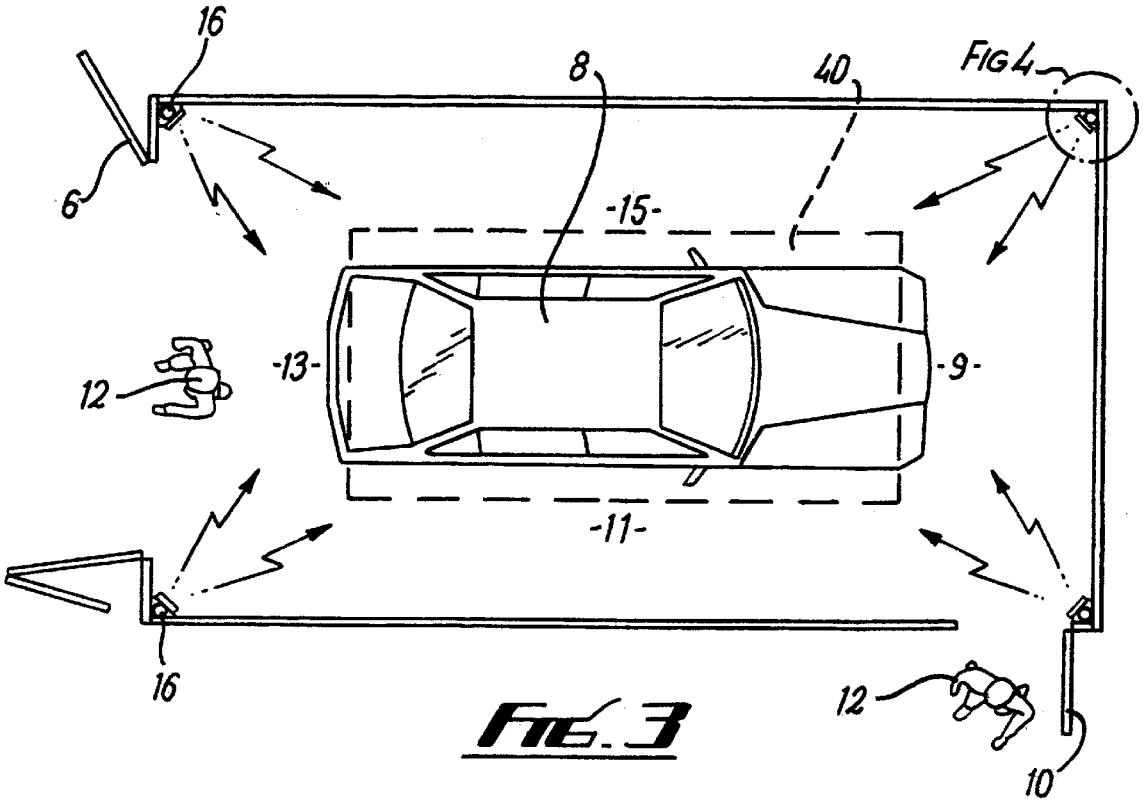
FIG. 3 is a plan view of the spraybooth of FIG. 1.
Figure 4:
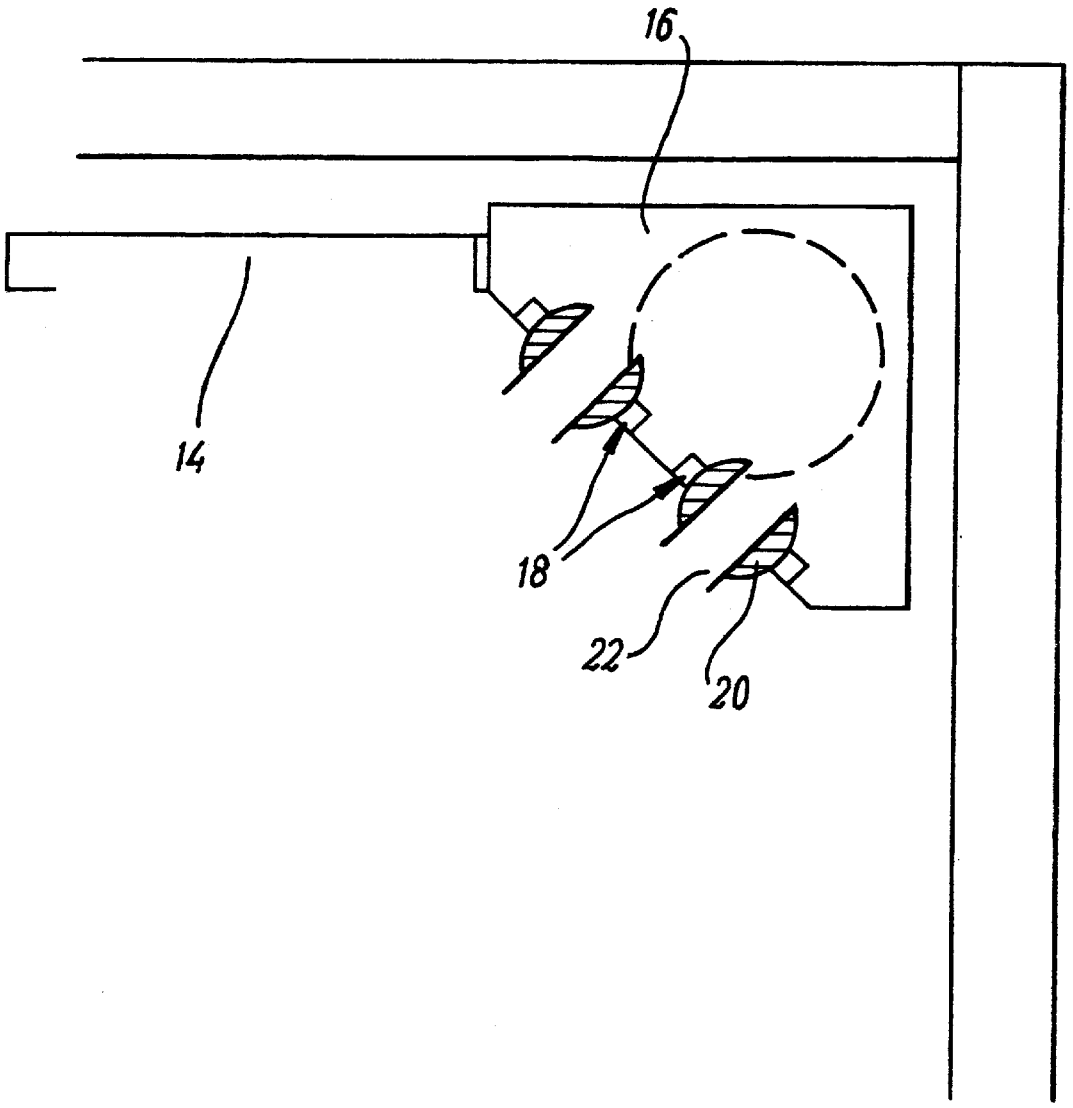
FIG. 4 is a cross-section view of an air jet of the spraybooth of FIG. 1.
Figure 5:
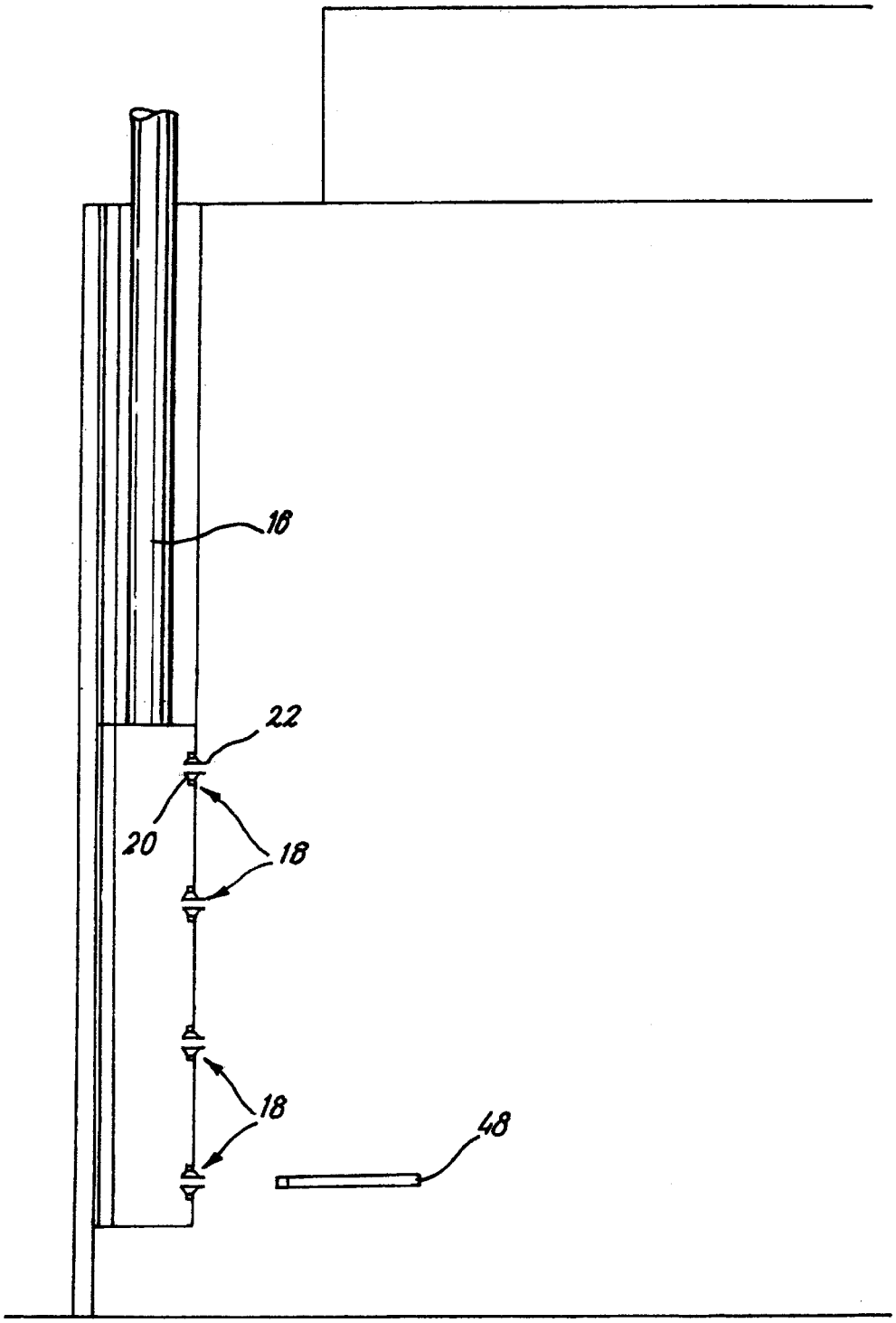
FIG. 5 is a perspective view of the air jet of FIG. 4 with a directing member.

Referring to the drawings, the paint drying system comprises a spraybooth 2 in which a body is first sprayed with a water-borne paint and subsequently dried during a flash off period in which water is released from the paint film.

The automobile in this embodiment is a motor car 8 of conventional length. The motor car 8 has a generally rectangular box construction.

The 'side surfaces' of this box are defined by the front, rear and sides proper of the motor car 8.

The spraybooth 2 has a enclosure 4 which is of generally rectangular box construction having four perpendicular walls and the motor car 8 is positioned in the booth with each of the four side portions generally aligned with a corresponding wall of the enclosure 4.

The enclosure 4 has pivotally mounted external triple doors 6 along a short side of the enclosure 4 thereby allowing the motor car 8 to be driven/pushed into and out of the enclosure 4.

The enclosure 4 also has a pivotally mounted single door 10 along one side, thereby enabling an operator 12 access to the enclosure 4.

The enclosure 4 has an air inlet system comprising an air inlet duct 32 which is connected to the enclosure 4 via a plenum chamber 28 having a box construction which is located in between the duct 32 and the enclosure 4. These components each include an air inlet and an air outlet so as to allow air from the atmosphere external to the spraybooth to pass through the duct 32 and the plenum chamber 28 into the enclosure 4.

The air flow into the chamber via the inlet system is enhanced by a number of pumps and fans. Two centrifugal fan units 30 are mounted on the plenum chamber 28, and are connected to motors 26. The fans 30 are each provided with a synthetic filter (not shown) which filters out particles greater than 10 microns in size. The fans 30 The air outlet 34 of the plenum chamber 28 comprises a filter, which is a layer of synthetic material operable to prevent particles greater than 10 microns in size entering the enclosure 4.

A further fan unit 38 is located in the air inlet duct 32, which also has a heating unit 36 mounted on the interior surface of the duct 32. The heating unit 36 is controllable via a temperature controller (not shown) which includes a thermostat (not shown).

The enclosure 4 incorporates a further air inlet comprising four corner units or pods 16, each pod 16 mounted in a corresponding corner of the enclosure 4.

Each pod comprises a triangular body in the form of an elongate shell of triangular cross section, mounted upright in a corresponding corner of the enclosure 4.

Each pod defines an internal enclosure or passageway which extends up to and is in fluid connection with the plenum chamber 28 by ducting 24. The fans 30 are operable to draw air from the plenum chamber 28 through the ducting 24 and the passageway and into the enclosure 4.

Each pod has two columns of four spaced apart substantially vertically aligned anti-static aluminium air jets 18. These are directed obliquely at the side surfaces 9, 11, 13, 15 of the motor car 8. Realignment of the air jets for each car is not generally necessary, after the system has been set up initially.

The two lowermost air jets 18 are positioned 300 mm from the base of the enclosure. The distance between consecutive vertically aligned air jets 18 is then 300 mm.

Each air jet comprises a sphere 20 having a substantially cylindrically shaped aperture therethrough, with the cylindrically shaped tubing 22 protruding from the opening.

An manually operable door 14 is mounted adjacent each pod and in the closed position each door conceals a corresponding pod 16. The door 14 may alternatively be electrically or pneumatically operable.

The air outlet system comprises a grid in the base of the enclosure, the grid formed by an array of spaced apart parallel and perpendicular members that form a lattice, below which is an extraction chamber 40 which houses a pump 42 and is connected to an outlet duct 44. The outlet duct 44 is connected to a chimney 46.

Before operating the spraybooth drying system the air jets may require orientation, e.g. on first setting up the system. This is to ensure air flows obliquely onto the painted surfaces of the automobile. The operator 12 manually directs the air jets 18 on the or each required passageway using a directing member 48. The directing member 48 comprises a cylindrical arm that can be inserted within a housing on the face of each air jet 18, and which thereby allows each air jet 18 to be adjusted accurately and with minimum exertion. The air jets 18 located on the passageway 16 which are not required may be made inoperable by closing the doors 14 adjacent the passageway 16, thereby concealing said air jets 18 behind the doors 14. The effect of closing said door 14 is intended to prevent paint overspray contamination of the air jets during the paint spraying operation.

The paint drying system is fully automated by means of a control system. The control system is in electrical connection with the temperature controller, each fan unit of the spraybooth, and the heater unit 36.

The control system incorporates a microprocessor-based control unit (not shown) having a user interface unit (not shown) and a data storage (memory) unit. System parameters such as drying time, heating unit temperature and timing, etc., may be input by an operator via the user interface unit. Pre-programmed dry system parameters may be stored in the memory unit.

The automated drying system may be operated by pressing the button on the user interface. The fan unit 38 is then activated to draw air into the air inlet duct 32. The air is directed along said duct and over the heating unit 36, which, under the control of the system, ensure the air temperature leaving said heating unit 36 is 35° C. After heating, the air travels to the plenum chamber 28, whereby some of it is ejected through the upper filter surface at between 0.2 $ms^{-1}$ and 1 $ms^{-1}$ and some of it is withdrawn into the pods 16 by the centrifugal fan units 30.

The air forced downwardly through the upper filter surface to the air outlet flows at 0.2–1 $ms^{-1}$.

The air drawn into the pods 16 is ejected from the air jets 18 transversely to the downdraft air flow at 25 $ms^{-1}$ and obliquely onto the surfaces of the motor car 8. The cumulative effect of the two air flows in combination with the interference caused by the motor car 8, produces a disruptive air movement within the spraybooth which passes over the motor car 8 at a desirable 2 $ms^{-1}$.

As the air does not flow directly at (i.e. perpendicular to) the surfaces of the motor car 8, water is not entrained into the paint. Instead, the obliquely directed airflow causes the formation of vortices along the painted surfaces which accelerate the drying thereof.

The pump 42 located within the extraction chamber 40 withdraws air from the enclosure 4 at a rate which is greater than or at least equivalent to that entering the enclosure 4, thereby ensuring the enclosure 4 remains neutrally or negatively pressurised.

Withdrawn air passes along the outlet duct 44 and is released via the chimney 46.

The control system is operable to control the entire drying operation ensuring that for one drying cycle the air is heated at 35° C. for a period of five minutes, after which the temperature is lowered to 22° C. for a period of two minutes before an alarm is sounded thereby informing said operator that the system has finished. The drying system parameters, e.g. temperature and time may be altered by the operator via the control device.

Individual components of the air drying system may be separately controlled by the control system. For example, when an motor car is being sprayed with paint in the booth, the heater unit 36 may be controlled to heat the air entering the spraybooth via the upper filter surface to a temperature of 21° C.

With the above described embodiments the spraybooth provides an effective means of drying water-borne paint treated objects efficiently and on a time scale comparable to the drying of solvent-borne paints.

The invention is not limited to the above described embodiments and many variations and modifications are possible.

What is claimed is:

1. A paint drying system for drying a painted body (8), the system comprising a spraybooth (2) having an enclosure (4), a first air inlet (32, 28), an air outlet, pump means (30) and a heater (36) to supply a first air flow from the atmosphere externally of the spraybooth to the first air inlet (32, 38) to flow through the enclosure (4) from the first air inlet (32, 28) to the air outlet, characterised by the provision of at least one second air inlet (18) which receives air from the atmosphere externally of the spraybooth (2) and directs a second air flow into the enclosure (4) transversely to said first air flow, a means being provided to heat the second air flow; wherein the first or at least one second air inlet is operable to direct air obliquely at one or more painted surfaces of the body.

2. A paint drying system according to claim 1 in which said first air flow is heated to a predetermined temperature by said heater (36).

3. A paint drying system according to claim 1 in which the air inlet is in the form of an first air inlet system including one or more ducts (32) in which said heater (36) is located.

4. A paint drying system according to claim 3 in which the air inlet system includes plenum chamber (28) located in between said one or more ducts (32) and the enclosure (4).

5. A paint drying system according to claim 4 in which said pump means (30) is located in the plenum chamber (28).

6. A paint drying system according to claim 1 in which said first air flow enters the enclosure (4) at a speed in the range of 0.2–1 $ms^{-1}$.

7. A paint drying system according to claim 1 in which the air inlet system incorporates a filter (34).

8. A paint drying system according to claim 7 in which the filter (34) is operative to remove particles exceeding 10 microns in size.

9. A paint drying system according to claim 7 in which the filter (34) is a synthetic filter.

10. A paint drying system according to claim 1 in which the at least one second air inlet (18) receives air from the first air inlet (32).

11. A paint drying system according to claim 1 in which said heating means (36) comprises one or more further heaters.

12. A paint drying system according to claim 10 in which the heating means provided to heat the second air flow comprises said heater (36).

13. A paint drying system according to claim 1 in which the at least one second air inlet (18) is operable to direct air obliquely at one or more painted surfaces of the body (8).

14. A paint drying system according to claim 1 in which the at least one second air inlet is operative to direct air into the enclosure at a speed in the range of 2–40 $ms^{-1}$.

15. A paint drying system according to claim 14 in which said speed is 25 $ms^{-1}$.

16. A paint drying system according to claim 1 in which the at least one second air inlet includes one or more air jets (18) to affect said direction of air transversely to the first air flow.

17. A paint drying system according to claim 16 in which the air jets (18) comprise material having anti-static properties.

18. A paint drying system according to claim 17 in which said material is aluminium.

19. A paint drying system according to claim 3 in which the air inlet system comprises one or more support members (16) located in the enclosure (4) and upon which the or each air jet (18) is located.

20. A paint drying system according to claim 19 in which the or each support member (16) is mounted on a wall of the enclosure (4) so as to define a passageway.

21. A paint drying system according to claim 19 in which the support member (16) is constructed to define a passageway.

22. A paint drying system according to claim 20 in which the passageway is connected to the a first air inlet so as to receive air therefrom.

23. A paint drying system according to claim 19 in which the support member (16) is a corner mounted unit (16).

24. A paint drying system according to claim 23 in which the corner unit (16) comprises an elongate shell of triangular cross section.

25. A paint drying system according to claim 19 in which the air jets (18) are arranged in ore or more columns along the support member (16).

26. A paint drying system according to claim 25 in which the air jets (18) in the or each column are aligned substantially vertical.

27. A paint drying system according to claim 26 in which the aligned air jets (18) are arranged 300 mm apart and a lowermost air jet (18) is located 300 mm from the base of the enclosure (4).

28. A paint drying system according to claim 16 in which the air jets (18) are adjustable so as to enable control of direction of the air therefrom.

29. A paint drying system according to claim 1 in which the at least one second air inlet includes one or more pumps.

30. A paint drying system according to claim 1 in which the at least one second air inlet includes a filter.

31. A paint drying system according to claim 30 in which the filter is a synthetic filter.

32. A paint drying system according to claim 30 in which the filter is operative to remove particles greater than 10 microns in size from the air.

33. A paint drying system according to claim 1 in which the outlet system incorporates one or more pumps (42) to extract air from the enclosure (4).

34. A paint drying system according to claim 1 in which the enclosure (4) is negatively pressurised.

35. A paint drying system according to claim 1 in which the enclosure includes one or more internal doors (14) arranged on or adjacent the at least one second air inlet and operable to affect open and closure thereof.

36. A paint drying system according to claim 1 in which the enclosure includes one or more external doors (6).

37. A paint drying system according to claim 1 in the which the paint drying system includes a control system.

38. A paint drying system according to claim 37 in which the control system is operable to control temperature of air supplied to the enclosure (4) by said first air inlet and said at least one second air inlet.

39. A paint drying system according to claim 38 in which said temperature is controlled by thermostatic control of the heater (36).

40. A paint drying system according to claim 37 in which the control system is operable to effect open and closure of internal doors (14) remotely of said doors.

41. A paint drying system according to claim 37 in which the control system incorporates a user interface to allow input of system parameters.

42. A paint drying system according to claim 41 in which the control system incorporates a microprocessor based control unit and a data storage unit to allow storage of system parameters.

43. A paint drying system according to claim 37 in which the control system incorporates a timer function, for timing of a drying cycle.

44. An auxiliary air inlet for a paint drying system for drying a painted body (8) which air inlet is suitable for use with a spraybooth (2), the spraybooth (2) comprising a enclosure (4), an air inlet (32), an air outlet, a pump (30) and a heater (36) to supply air from the atmosphere externally of the spraybooth (2) to the air inlet (32) to flow through the enclosure (4) from the air inlet to the air outlet; the auxiliary inlet comprising one or more air jets (18) which receive air from the atmosphere externally of the spraybooth (2), the one or more air jets (18) being adjustably mounted in one or more pods (16), each pod (16) adapted to be mounted in the enclosure (4) so that the or each air jet (18) directs air obliquely at surfaces of the painted body (8).

45. An auxiliary air inlet according to claim 44 in which the or each pod is mounted in a corner of the spraybooth (2).

46. An auxiliary air inlet according to claim 44 in which the pod (16) comprises a triangular shaped body.

47. An auxiliary air inlet according to claim 44 in which the spraybooth (2) includes temperature control means and the auxiliary air inlet includes a control system operable to interface and override said temperature control means.

48. A paint drying system for drying a painted body (8), the system comprising a spraybooth (2) having an enclosure (4), an air inlet (32), a plenum chamber (28), an air outlet and a pump (30) to supply air from the atmosphere externally of the spraybooth (2) to the air inlet to flow from the air inlet (32) via the plenum chamber (28) through the enclosure (4) and to the air outlet, wherein at least one further air inlet (18) is provided which directs air obliquely at surfaces of the painted body (8), characterised in that the further air inlet (18) receives air from the atmosphere externally of the spraybooth (2) via the plenum chamber (28).

49. A paint drying system according to claim 1 when used to dry a body (8) painted with a water-borne paint.

50. A paint drying system according to claim 1 when used to dry a motor car (8).

51. A paint drying system according to claim 6 in which said speed is 0.5 $ms^{-1}$.

* * * * *